United States Patent [19]

Yamazaki et al.

[11] Patent Number: 4,957,594

[45] Date of Patent: Sep. 18, 1990

[54] PROCESS FOR PRODUCING A ZINC OR ZINC ALLOY COATED STEEL SHEET HAVING EXCELLENT SPOT WELDABILITY

[75] Inventors: Kazumasa Yamazaki; Yaichiro Mizuyama; Takashi Horita; Shinichi Suzuki, all of Tokai, Japan

[73] Assignee: Nippon Steel Corporation, Tokyo, Japan

[21] Appl. No.: 309,260

[22] Filed: Feb. 13, 1989

[30] Foreign Application Priority Data

| | | | |
|---|---|---|---|
| Feb. 19, 1988 | [JP] | Japan | 63-35034 |
| Aug. 9, 1988 | [JP] | Japan | 63-197260 |
| Sep. 22, 1988 | [JP] | Japan | 63-236238 |

[51] Int. Cl.[5] ..... C25D 5/00; C25D 9/08

[52] U.S. Cl. ..... 204/27; 204/38.4; 204/40; 204/55.1; 204/56.1; 427/406; 427/419.2; 428/629; 428/632; 428/659

[58] Field of Search ..... 428/629, 632, 659; 427/406, 419.2; 204/27, 28, 40, 55.1, 56.1, 38.4

[56] References Cited

U.S. PATENT DOCUMENTS

| | | | |
|---|---|---|---|
| 2,884,350 | 4/1959 | Saubestre | 428/629 |
| 3,822,118 | 2/1974 | Fukuzuka et al. | 204/40 X |
| 4,707,415 | 11/1987 | Ikeda et al. | 428/621 |

FOREIGN PATENT DOCUMENTS

| | | |
|---|---|---|
| 55-110781 | 8/1980 | Japan . |
| 55-110783 | 8/1980 | Japan . |
| 59-104463 | 6/1984 | Japan . |
| 60-63394 | 4/1985 | Japan . |

*Primary Examiner*—G. L. Kaplan

*Attorney, Agent, or Firm*—Cushman, Darby & Cushman

[57] ABSTRACT

A zinc- or zinc alloy-coated steel sheet having an excellent spot-weldability, comprising: a base steel sheet; one or more layers coated on the steel sheet, at least one of the coated layers containing zinc as a major component; and an oxidized layer formed on the outermost of the coated layers and containing zinc in an amount of from 0.03 to 3.0 g/m$^2$, the oxidized layer containing at least one of zinc oxide and zinc hydroxide.

4 Claims, No Drawings

PROCESS FOR PRODUCING A ZINC OR ZINC ALLOY COATED STEEL SHEET HAVING EXCELLENT SPOT WELDABILITY

BACKGROUND OF THE INVENTION

1. Field of the Invention

The present invention relates to a zinc- or zinc alloy-coated steel sheet having an excellent spot-weldability, and to a process for producing same.

2. Description of the Related Art

Processes for improving the spot-weldability of zinc- or zinc alloy-coated steel sheets are disclosed in Japanese Unexamined Patent Publication (Kokai) Nos. 55-110783 and 60-63394, for example, in which an oxide film such as $Al_2O_3$ is formed on a zinc- or zinc alloy-coated steel sheet and a high electric resistivity of the oxide film is utilized to promote welding and prevent contact between an electrode tip and the steel sheet to be welded, with the result that the tip loss by fusion is prevented to increase the tip life.

Another method for improving the spot-weldability is disclosed in Japanese Unexamined Patent Publication (Kokai) No. 59-104463, in which a coated steel sheet is heat-treated to form thereon an oxidized film having a ZnO/Zn ratio of from 0.1 to 0.70.

These publications, however, do not give satisfactory results in the practical manufacturing process, and a further improvement is required for the spot-weldability of the coated steel sheet.

Further, a conventional process effective for any kind of zinc- or zinc alloy-coated steel sheet and a process available for various kinds of such steel sheets has not been developed, despite the need for same.

SUMMARY OF THE INVENTION

To comply with the above need, an object of the present invention is to provide a zinc- or zinc alloy-coated steel sheet having an excellent spot-weldability, which improves the electrode tip life and enables a long term spot-welding operation without the need for a change of the tip.

A further object of the present invention is to provide a process for producing a zinc- or zinc alloycoated steel sheet having an excellent spot-weldability, which improves the electrode tip life and enables a long term spot-welding operation without the need for a change of the tip.

DESCRIPTION OF THE PREFERRED EMBODIMENTS

The above object is achieved, according to the present invention, by a zinc- or zinc alloy-coated steel sheet having an excellent spot-weldability, comprising:

a base steel sheet, one or more layers coated on said steel sheet, at least one of said coated layers containing zinc as a major component, and an oxidized layer formed on the outermost of said coated layers and containing zinc in an amount of from 0.03 to 3.0 g/m$^2$, said oxidized layer containing at least one of zinc oxide and zinc hydroxide.

The oxidized layer containing at least one of zinc oxide and zinc hydroxide of the present invention contains ZnO and $Zn(OH)_2$, etc. —including non-stoichiometric forms thereof, generally expressed by $Zn_xO_y$ and $Zn_x(OH)_y$—, and may contain oxides of metals from the outermost layer, such as $ZnFe_2O_4$ etc., for iron-zinc alloy plated steel sheets, for example, as well as substances from the bath used for forming the oxidized layer.

The steel sheet of the present invention is produced, according to the present invention, by a process for producing a zinc- or zinc alloy-coated steel sheet having an excellent spot-weldability, comprising the steps of:

preparing a steel sheet having one or more layers coated thereon, at least one of said coated layers containing zinc as a major component, and depositing zinc on the outermost of said coated layers with a simultaneous oxidation of zinc deposited by an electrolytic or electroless reaction in a solution containing zinc ion and one or more oxidizing agents to form an oxidized layer on the outermost of said coated layers in an amount of from 0.03 to 3.0 g/m$^2$ in terms of the zinc content of said oxidized layer, and oxidized layer containing at least one of zinc oxide and zinc hydroxide.

The process of the present invention is advantageously carried out according to any of the following embodiments (a) to (c):

(a) A process for producing a zinc- or zinc alloy-coated steel sheet having an excellent spot-weldability, comprising the steps of:
  - preparing a steel sheet having one or more layers coated thereon, at least one of said coated layers containing zinc as a major component, and
  - subjecting said steel sheet to an electrogalvanizing treatment in a plating bath containing 0.5 to 30% of hydrogen peroxide to form an oxidized layer on the outermost of said coated layers in an amount of from 0.03 to 3.0 g/m$^2$ in terms of the zinc content of said oxidized layer, said oxidized layer containing at least one of zinc oxide and zinc hydroxide.

(b) A process for producing a zinc- or zinc alloy-coated steel sheet having an excellent spot-weldability, comprising the steps of:
  - preparing a steel sheet having one or more layers coated thereon, at least one of said coated layers containing zinc as a major component, and
  - subjecting said steel sheet to an electrolysis using said steel sheet as a cathode in an acidic bath containing zinc ion and one or more oxidizing agents to form an oxidized layer on the outermost of said coated layers in an amount of from 0.03 to 3.0 g/m$^2$ in terms of the zinc content of said oxidized layer, said oxidized layer containing at least one of zinc oxide and zinc hydroxide.

(c) A process for producing a zinc- or zinc alloy-coated steel sheet having an excellent spot-weldability, comprising the steps of:
  - preparing a steel sheet having one or more layers coated thereon, at least one of said coated layers containing zinc as a major component, and
  - placing said steel sheet in contact with a solution containing zinc ion and one or more oxidizing agents to form an oxidized layer on the outermost of said coated layers in an amount of from 0.03 to 3.0 g/m$^2$ in terms of the zinc content of said oxidized layer, said oxidized layer containing at least one of zinc oxide and zinc hydroxide.

The zinc- or zinc alloy-coated steel sheets to which the present invention can be applied include steel sheets coated by hot-dip plating, electroplating, vapor deposition coating, or flame spray coating, etc. The compositions of the coated layers include pure zinc, zinc alloys containing zinc as a major component, one or more of iron, nickel, aluminum, manganese, and other alloying elements for improving the steel sheet properties such as corrosion resistance, and impurity elements. Some of the steel sheets have one or more coating layers in which fine particles of $SiO_2$, $Al_2O_3$ or other ceramics, particles of $TiO_2$ or other oxides, or particles of organic high molecular compounds are dispersed. In some cases, the composition of a coating layer may be unchanged with respect to the layer thickness direction, or in other cases, may vary continuously or in the laminar mode. Some multilayer-coated steel sheets have a layer, as the outermst, intermediate, or innermost layer, which contains iron and nickel as major components and other various alloying elements such as phosphorus but contains no or a lesser amount of zinc.

Therefore, the zinc- or zinc alloy-coated steel sheets to which the present invention can be applied include, for example, hot-dip galvanized steel sheets;

iron-zinc alloyed hot-dip galvanized steel sheets;

alloyed hot-dip galvanized steel sheets having a coating layer of an alloy composed of zinc as a major component and aluminum, iron or other alloying elements;

alloyed hot-dip galvanized steel sheets having the innermost layer of an alloy (commonly called "half alloy");

hot-dip galvanized steel sheets having a hot-dipped coating of an iron-zinc alloy on one side and a hot-dipped coating of zinc on another side;

plated steel sheets produced by further plating any of the above-mentioned plated steel sheets with an alloy composed of zinc, iron, and nickel as major components by electroplating, or vapor deposition coating, etc;

electrogalvanized steel sheets;

alloyed electroplated steel sheets having a plated layer of an alloy of zinc, nickel, or chromium, etc;

mono- or multi-layer alloyed electroplated steel sheets;

plated steel sheets produced by a further coating of any of the above-mentioned plated steel sheets with an organic film;

vapor-deposition-coated steel sheets coated with zinc or an zinc alloy; and dispersion plates steel sheets having a plated layer of zinc or zinc alloy in which fine particles of $SiO_2$, $Al_2O_3$ or other ceramics, particles of $TiO_2$ or other oxides, or particles of organic high molecular compounds, etc., are dispersed.

When spot-welding these plated steels, the plated layer is fused by heat generated during welding, and copper, a component of the electrode tip, selectivity reacts with metals of the plated layer to form a hard brittle alloy layer which causes tip loss and lessens the tip life.

According to the present invention, an oxidized layer containing at least one of zinc oxide and zinc hydroxide is formed on the outermost of the coated layers of a steel sheet in an amount of from 0.03 to 3.0 $g/m^2$ in terms of the zinc content thereof. When spot-welded, the oxidized layer present between the electrode tip and the outermost coated layer prevents the selective alloying of the copper of the tip and metals of the coated layers, and thus significantly delays the tip loss.

The oxidized layer must be formed in an amount within the specified range of from 0.03 to 3.0 $g/m^2$ in terms of the zinc content contained in the layer. An amount less than 0.03 $g/m^2$ does not provide the above-mentioned effect, and an amount more than 3.0 $g/m^2$ causes an impairment of the conversion treatability of the steel sheet.

The effect of the oxidized layer is considered to be brought about by the following mechanism. The oxidized layer prevents contact between the electrode tip and the coated layer and, in turn, the tip loss by fusion caused by the formation of an alloyed layer. At the same time, an alloying of fused metals from the coated layer with iron from the base steel sheets occurs, to form an alloy containing iron as a major component, and the thus formed alloy adheres to the electrode tip head to a certain extent and forms a protective metal film, which does not significantly change in thickness or shape during a long term spot-welding operation, to ensure a successful welding condition without a premature loss of the electrode tip.

The protective metal film is mainly composed of metals of the coated layers and iron of the base steel sheets and, in most cases, of about 20–60% iron and about 48–80% zinc, in which higher iron concentration are generally preferred. The film may also contain manganese, sulfur, or other components of the base steel sheets, chromium or other components of the products from conversion treatment or other surface treatments, or copper or other components of the electrode tip.

As described above, the improvement of the spot-weldability is achieved by a provision of an oxidized layer containing at least one of zinc oxide and zinc hydroxide on the outermost of the coated layers of a steel sheet. When the outermost of coated layers contains zinc in a significant amount, merely oxidizing the outermost layer can form the oxidized layer containing at least one of zinc oxide and zinc hydroxide. But, when the outermost layer contains none or little zinc, a mere oxidation cannot result in the formation of such oxidized layer and is not commonly effective for all kinds of zinc- or zinc alloy-coated steel sheets such as previously described.

The present inventors have found the processes (a), (b), and (c), as previously described, effective for all kinds of zinc- or zinc alloy-coated steel sheets.

The first embodiment process (a) of the present invention comprises the steps of:

preparing a steel sheet having one or more layers coated thereon, at least one of said coated layers containing zinc as a major component, and subjecting said steel sheet to an electrogalvanizing treatment in a plating bath containing 0.5 to 30% of hydrogen peroxide to form an oxidized layer on the outermost of said coated layers in an amount of from 0.03 to 3.0 $g/m^2$ in terms of the zinc content of said oxidized layer, said oxidized layer containing at least one of zinc oxide and zinc hydroxide.

The electrogalvanizing per se is conducted in a usual manner, i.e., under the presence of zinc ion in the plating bath.

In this process, electrogalvanizing of a zinc- or zinc alloy-coated steel sheet involves a simultaneous oxidation of zinc deposited on the outermost of the coated layers with the aid of hydrogen peroxide, which is a strong oxidizing agent.

The plating bath is prepared by adding 0.5 to 30% of hydrogen peroxide to a conventional electrogalvanizing bath containing, for example, zinc sulfate, sulfuric acid, and other additives.

The addition of hydrogen peroxide causes a simultaneous oxidation of zinc adhering to the outermost layer of the steel sheet, to form zinc oxide and/or zinc hydroxide, which improve the spot-weldability of a steel sheet.

The amount of hydrogen peroxide in the plating bath must be within the specified range, since an amount less than 0.5% does not provide a sufficient oxidation of zinc adhering to the outermost layer and an amount more than 30% does not provide a further oxidation but only an undesired increase in the production cost.

The plating bath may contain organic additives and/or impurities, other than the conventional major components of zinc sulfate and sulfuric acid.

The second embodiment process (b) of the present invention comprises the steps of:

preparing a steel sheet having one or more layers coated thereon, at least one of said coated layers containing zinc as a major component, and subjecting said steel sheet to an electrolysis using said steel sheet as a cathode in an acidic bath containing zinc ion and one or more oxidizing agents to form an oxidized layer on the outermost of said coated layers in an amount of from 0.03 to 3.0 g/m$^2$ in terms of the zinc content of said oxidized layer, said oxidized layer containing at least one of zinc oxide and zinc hydroxide.

In this process, electrolysis of a zinc- or zinc alloy-coated steel sheet causes a deposition of zinc on the outermost of the coated layers with a simultaneous oxidation of zinc deposited on the outermost of the coated layers under the presence of oxidizing agents in an acidic bath.

The oxidizing agents referred to here include ozone, peroxides, permanganic acid and permanganates, bichromates, hypochlorous acid and hypochlorites, chlorous acid and chlorites, chloric acid and chlorates, hypobromous acid and hypobromites, bromic acid and bromates, hypoiodous acid and hypoiodites, iodic acid and iodates, and nitric acid and nitrates, etc.

The peroxides includes, for example, potassium peroxide, hydrogen peroxide, sodium peroxide, sodium hydrogen peroxide, barium peroxide, and magnesium peroxide, etc., each generating hydrogen peroxide when present in an acidic solution and having a strong oxidizing effect.

These oxidizing agents may be used either separately or in combination or with acids, to enhance the oxidizing effect.

In this process of the present invention, electrolysis is performed in an aqueous solution containing the above-mentioned oxidizing agents. Nitric acid and nitrates are the most preferable oxidizing agents from the viewpoint of the bath stability, waste liquor treatment, and safe operation, as well as the production cost.

The zinc ion content of the plating bath is necessarily determined as the $Zn^{30\ 2}$ content required for forming an oxidized layer in an amount within the specified range of from 0.03 to 3.0 g/m$^2$ in terms of the zinc content of the oxidized layer. The oxidizing agent content of the plating bath is also necessarily determined as a content required for oxidizing this amount of zinc ion.

Zinc ion is introduced in the plating bath by solving metallic zinc, or adding zinc nitrate, zinc chloride, or other zinc compounds. Zinc ion solved from zinc containing coated layer of a steel sheet also may be utilized for this purpose.

This third embodiment process (c) of the present invention comprises the steps of:

preparing a steel sheet having one or more layers coated thereon, at least one of said coated layers containing zinc as a major component, and placing said steel sheet in contact with a solution containing zinc ion and an oxidizing agent to form an oxidized layer on the outermost of said coated layers in an amount of from 0.03 to 3.0 g/m$^2$ in terms of the zinc content of said oxidized layer, said oxidized layer containing at least one of zinc oxide and zinc hydroxide.

In this process of the present invention, placing a zinc- or zinc alloy-coated steel sheet in contact with a solution containing zinc ion and an oxidizing agent causes a deposition of zinc on the outermost coated layer of the steel sheet with a simultaneous oxidation of zinc adhering to the outermost coated layer.

The oxidizing agents referred to here include those described for the above second process (b) of the present invention. However, peroxides are not preferably used in this process (c) since, to obtain a sufficient effect, they are required in this process in an amount greater than that required in the second process (b), in which a minute amount of peroxides is effective in the electrolytic reaction, and peroxides present in a large amount violently decompose under the presence of metal ions and shorten the solution life.

These oxidizing agents may be used either separately or in combination, or with acids, to enhance the oxidizing effect, as in the process (c) of the present invention.

The zinc ion content of the solution of the process (c) is preferably 5 g/l or more, since an amount less than this value causes a relatively small amount of zinc oxide and/or zinc hydroxide to be formed. On the other hand, the zinc ion content is preferably 1000 g/l or less, since an amount more than this value merely results in an increased cost of production.

As in the process (b), zinc ion is introduced in the plating bath by solving metallic zinc, or adding zinc nitrate, zinc chloride, or other zinc compounds. Zinc ion solved from zinc-containing coated layers of a steel sheet also may be utilized for this purpose.

EXAMPLES

Example 1

Zinc- or zinc alloy-coated steel sheets of the present invention were produced according to the first embodiment process (a) of the present invention.

The results for the inventive steel sheets and comparative steel sheets are summarized in Table 1.

TABLE 1

| | No. | Coated Layers: Lower Layer (Coating weight: g/m$^2$) | | Coated Layers: Upper Layer (Coating weight: g/m$^2$) | | Electrogalvanizing Condition: $H_2O_2$ Concentration of Plating Bath (%) | Electrogalvanizing Condition: Zinc content of Oxidized Layer (g/m$^2$) | Spot-Welding Number | Conversion Treatability |
|---|---|---|---|---|---|---|---|---|---|
| Present Invention | 1 | AS (Both Sides) | 100/100 | — | — | 30 | 0.04 | 8000 | o |
| | 2 | AS (Both Sides) | " | — | — | 10 | 0.2 | 6500 | o |

TABLE 1-continued

| | No. | Coated Layers: Lower Layer (Coating weight: g/m²) | | Coated Layers: Upper Layer (Coating weight: g/m²) | | Electrogalvanizing Condition: $H_2O_2$ Concentration of Plating Bath (%) | Electrogalvanizing Condition: Zinc content of Oxidized Layer (g/m²) | Spot-Welding Number | Conversion Treatability |
|---|---|---|---|---|---|---|---|---|---|
| | 3 | AS (Both Sides) | " | — | — | 5 | 1.0 | 6000 | o |
| | 4 | AS (Both Sides) | 60/60 | — | — | 30 | 2.8 | 7000 | o |
| | 5 | AS (Both Sides) | 45/60 | Fe—Zn | 3.0 | 0.5 | 0.8 | 6000 | o |
| | 6 | AS (Both Sides) | " | Zn—Ni | 2.0 | 20 | 2.0 | 7000 | o |
| | 7 | AS/GI | 40/60 | — | — | 20 | 1.2 | 7000 | o |
| | 8 | " | " | Fe—Zn | 3.0 | 20 | 0.7 | 7000 | o |
| | 9 | GI (Both Sides) | 50/50 | " | 1.0 | 10 | 1.3 | 6500 | o |
| | 10 | EG (Both Sides) | 20/20 | — | — | 8 | 2.2 | 6000 | o |
| | 11 | EL (Both Sides) | 20/20 | — | — | 15 | 0.06 | 6000 | o |
| | 12 | ZL (Both Sides) | 20/20 | — | — | 25 | 0.8 | 6500 | o |
| | 13 | AS (Both Sides) | 45/45 | Fe—P | 3.0 | 5 | 0.8 | 6000 | o |
| | 14 | EL (Both Sides) | 20/20 | Ni—P | 0.8 | 10 | 1.0 | 6500 | o |
| | 15 | EG + $SiO_2$ | 20/20 | — | — | 10 | 0.8 | 6000 | o |
| | 16 | AS (Both Sides) | 45/45 | Fe—Zn + $Al_2O_3$ | 1.0 | 10 | 0.8 | 6000 | o |
| Comparative Sample | 17 | AS (Both Sides) | 60/60 | — | — | 0.01 | 1.2 | 3000 | o |
| | 18 | AS (Both Sides) | " | Fe—Zn | 1.0 | 30 | 4.0 | 6000 | x |
| | 19 | AS (Both Sides) | " | — | — | — | — | 500 | o |

The following zinc- or zinc alloy-coated steel sheets were used:

Symbol: Steel Sheet

AS: Iron-zinc alloy hot-dip coated steel sheet produced by hot-dip galvanizing followed by heat-treatment to obtain a coated layer of 7–13% Fe and a balance of zinc. GI: Hot-dip galvanized steel sheet. EG: Electrogalvanized steel sheet. ZL: Zinc-nickel alloy electroplated steel sheet. EL: Iron-zinc alloy two-layer electroplated steel sheet having a lower layer of 85% zinc and 15% iron and an upper layer of 15% zinc and 85% iron.

$SiO_2$: Steel sheet having a layer in which $SiO_2$ particles are dispersed.

$Al_2O_3$: Steel sheet having a layer in which $Al_2O_3$ particles are dispersed.

The base steel sheets used were 0.8 mm thick common steel sheets.

Electrogalvanizing was carried out in a plating bath containing 250 g/l of $ZnSO_4$ — $7H_2O$ and hydrogen peroxide in an amount shown in Table 1, and at a current density of 100 A/dm².

Spot-welding was carried out under the following conditions:

Pressing force: 250 kg

Initial pressing time: 40 Hz

Current conducting period: 12 Hz

Holding time: 5 Hz

Welding current: 11 kA

Tip head diameter: 5.0 Φ (truncated cone type)

Electrode tip life: Maximum spot-welding numbers at which the nugget diameter at an 85% welding current can be ensured.

Material of electrode: Cu-Cr commonly used.

Two pieces of each steel sheet were disposed with the same side facing up, and were overlapped one on the other, and were spot-welded, in which the welding numbers were continuously counted.

To determine the zinc content of the oxidized layer formed, the layer was dissolved with 5% iodine methanol solution, and the extracted residue was fused with a mixed fusing agent (boric acid: zinc carbonate =1:3) and dissolved in hydrochloric acid to form a solution, which was then subjected to ICAP (inductively coupled argon plasma emission spectrophotometer) analysis.

To evaluate the conversion-treatability, the steel sheets were conversion-treated with Bt 380 from the Nihon Parkerizing Co., Japan under a standard condition, and the growth of zinc phosphate crystals on the steel sheet surface was observed by using a scanning electron microscope at a magnification of 400. When an oxidized layer was formed in an excessive amount, no growth of the phosphate crystal was observed at some points on the steel sheet surface, which is denoted by symbol "x" in Table 1. Symbol "o" in Table 1 represents that such a "no growth point" was not observed and the steel sheet had a good conversion-treatability.

The results show that the electrode tip life was remarkably improved for the inventive steels in comparison with that for the comparative steel sheets.

Example 2

Zinc- or zinc alloy-coated steel sheets of the present invention were produced according to the second embodiment process (b) of the present invention.

The results are summarized in Table 2 for the inventive steel sheets and comparative steel sheets.

TABLE 2

| | No. | Coated Layer (Coating Weight: g/m²) | Bath Composition (g/l) | Electrolysis Condition: Current Density (A/dm²) | Electrolysis Condition: Duration (sec) | Zinc Content of Oxidized Layer (mg/m²) | Spot-Welding Number | Conversion-Treatability |
|---|---|---|---|---|---|---|---|---|
| Present Invention | 1 | (Both Sides) AS 60/60 | $ZnSO_4.7H_2O$: 100, $NaNO_3$: 50 $H_2SO_4$: 5 | 10 | 3 | 180 | >6000 | o |
| | 2 | (Both Sides) AE 60/60 | $ZnSO_4.7H_2O$: 50, $NaNO_3$: 50 $FeSO_4.7H_2O$: 10, $H_2SO_4$: 5 | 5 | 5 | 220 | >6000 | o |
| | 3 | (Both Sides) EL 20/20 | $ZnSO_4.7H_2O$: 30, $HNO_3$: 10 $H_2SO_4$: 2 | 3 | 3 | 230 | >6000 | o |
| | 4 | (Both Sides) ZL 20/20 | $ZnSO_4.7H_2O$: 30, $NaClO_3$: 5 $H_2SO_4$: 1 | 5 | 5 | 300 | >6000 | o |
| | 5 | (Both Sides) EG 20/20 | $ZnCl_2$: 100, $NaNO_3$: 50, HCl: 3 | 10 | 10 | 1500 | >6000 | o |
| | 6 | (One Side) AS 45/45 | $ZnCl_2$: 150; $KMnO_4$: 5, HCl: 5 | 2 | 3 | 560 | >6000 | o |
| | 7 | (Both Sides) AE 60/30 | $ZnSO_4.7H_2O$: 100, $H_2O_2$: 60 | 5 | 6 | 320 | >6000 | o |
| | 8 | (Both Sides) EL 20/— | $ZnSO_4.7H_2O$: 50, $K_2Cr_2O_7$: 10 | 30 | 5 | 620 | >6000 | o |
| Comparative Sample | 9 | (Both Sides) AS 60/60 | $ZnSO_4.7H_2O$: 200, $H_2SO_4$: 8 | 20 | 5 | 5 | 700 | o |
| | 10 | (Both Sides) AE 60/60 | $ZnSO_4.7H_2O$: 200, $H_2O_2$: 60 $H_2SO_4$: 5 | 30 | 20 | 3200 | >6000 | x |
| | 11 | (Both Sides) EG 20/20 | $ZnCl_2$: 50, $NaNO_3$: 10 | 2 | 1 | 18 | 1000 | o |

The following zinc- or zinc alloy-coated steel sheet were used:

Symbol: Steel Sheet

AE: Two-layer coated steel sheet having a lower layer of an alloyed hot-dip galvanized coating and an upper layer of more than 80% iron and the balance zinc.

AS, EG, ZL, EL, $SiO_2$, and $Al_2O_3$: (same as in Example 1)

The base steel sheets were 0.8 mm thick common steel sheets.

Electrolysis was carried out under the conditions shown in Table 2, and spot-welding was carried out under the same conditions as in Example 1.

The conversion-treatability was evaluated in the same way as in Example 1.

The results show that the electrode tip life is remarkably improved for the inventive steels in comparison with that for the comparative steel sheets.

Example 3

Zinc- or zinc alloy coated steel sheets of the present invention were produced according to the third embodiment process (c) of the present invention.

The results are summarized in Table 3 for the inventive steel sheets and comparative steel sheets.

TABLE 3

| | No. | Coated Layer (Coating Weight: g/m²) | Bath Composition | Immersing Condition: Bath Temp. (°C.) | Immersing Condition: Duration (sec) | Zinc Content of Oxidized Layer (mg/m²) | Spot-Welding Number | Conversion Treatability |
|---|---|---|---|---|---|---|---|---|
| Present Invention | 1 | (Both Sides) AE 60/60 | $Zn(NO_3)_2.6H_2O$; 750 g/l, $NaNO_3$; 56 g/l, $HNO_3$; 3 g/l | 50 | 5 | 210 | >6000 | o |
| | 2 | (Both Sides) AS 60/60 | $Zn(NO_3)_2.6H_2O$; 150 g/l, $NaNO_3$; 56 g/l, $HNO_3$; 3 g/l | 50 | 3 | 150 | >6000 | o |
| | 3 | (Both Sides) EL 20/20 | $Zn(NO_3)_2.6H_2O$; 10 g/l, $NaNO_3$; 10 g/l, $HNO_3$; 1 g/l | 40 | 7 | 680 | >6000 | o |
| | 4 | (Both Sides) AE 60/30 | $ZnCl_2$; 150 g/l, $NaNO_3$; 100 g/l, $HNO_3$; 6 g/l | 40 | 2 | 80 | >6000 | o |
| | 5 | (Both Sides) EG 20/20 | $ZnSO_4.7H_2O$; 100 g/l, $KMnO_4$; 5 g/l, $H_2SO_4$; 8 g/l | 30 | 2 | 95 | >6000 | o |
| | 6 | (Both Sides) AS 40/40 | $Zn(NO_3)_2.6H_2O$; 500 g/l, $K_2Cr_2O_7$; 10 g/l | 20 | 5 | 250 | >6000 | o |
| | 7 | (One Side) EL 20/— | $ZnCl_2$; 50 g/l, $NaClO_3$; 5 g/l, HCl: 3 g/l | 50 | 3 | 130 | >6000 | o |
| | 8 | $SiO_2$ ZL 20/20 | $Zn(NO_3)_2.6H_2O$; 500 g/l, $NaNO_3$; 10 g/l | 50 | 4 | 110 | >6000 | o |
| Comparative Sample | 9 | (Both Sides) AS 60/60 | $Zn(NO_3)_2.6H_2O$; 5 g/l | 20 | 1 | 5 | 700 | o |
| | 10 | (Both Sides) AE 60/45 | $Zn(NO_3)_2.6H_2O$; 900 g/l, $HNO_3$; 3 g/l | 50 | 20 | 3200 | >6000 | x |
| | 11 | (Both Sides) EG 20/20 | $ZnCl_2$; 50 g/l HCl; 2 g/l | 50 | 3 | 2 | 500 | o |

The zinc- or zinc alloy-coated steel sheets used were the same as in Example 2.

The steel sheets were immersed in the respective solutions under the conditions, as shown in Table 3.

Spot-welding was carried out under the same condition as in Example 1, and the conversion-treatability was evaluated in the same way as in Example 1.

The results show that the electrode tip life was remarkably improved for the inventive steels in comparison with that for the comparative steel sheets.

As described above, the present inventive steel increases the continuous spot-welding number, enables a long term spot-welding operation without a change of the electrode tip, and improves the electrode tip durability. The present invention thus provides further advantages in that spot-welding productivity is improved, an appropriate welding current range at the same level as that used in the conventional spot-welding may be used, and a good weldability is ensured.

We claim:

1. A process for producing a zinc- or zinc alloy-coated steel sheet having an excellent spot-weldability comprising the steps of:

coating a steel sheet with one or more layers wherein, at least one of said coated layers contains zinc as a major component, and depositing zinc on the outermost of said coated layers with a simultaneous oxidation of zinc deposited by an electrogalvanizing treatment in a plating bath containing zinc ions and 0.5 to 30% of hydrogen peroxide to form an oxidized layer on the outermost of said coated layers in an amount of from 0.03 to 3.0 g/m$^2$ in terms of the zinc content of said oxidized layer, said oxidized layer containing at least one of zinc oxide and zinc hydroxide.

2. A process for producing a zinc- or zinc alloy-coated steel having an excellent spot-weldability, comprising the steps of:

coating a steel sheet with one or more layers wherein, at least one of said coated layers contains zinc as a major component, and depositing zinc on the outermost of said coated layers with a simultaneous oxidation of zinc deposited by electrolysis using said steel sheet as a cathode in an acidic bath containing zinc ions and one or more oxidizing agents selected from the group consisting of nitric acid and nitrates to form an oxidized layer on the outermost of said coated layers in an amount of from 0.03 to 3.0 g/m$^2$ in terms of the zinc content of said oxidized layer, said oxidized layer containing at least one of zinc oxide and zinc hydroxide.

3. A process for producing a zinc- or zinc alloy-coated steel sheet having an excellent spot-weldability, comprising the steps of:

coating a steel sheet with one or more layers wherein, at least one of said coated layers contains zinc as a major component, and depositing zinc on the outermost of said coated layers with a simultaneous oxidation of zinc deposited by contacting with a solution containing zinc ions and one or more oxidizing agents selected from the group consisting of nitric acid and nitrates to form an oxidized layer on the outermost of said coated layers in an amount of from 0.03 to 3.0 g/m$^2$ in terms of the zinc content of said oxidized layer, said oxidized layer containing at least one of zinc oxide and zinc hydroxide.

4. A process according to claim 3, wherein said solution contains zinc ion in an amount of from 5 to 1000 g/l.

* * * * *